US010221605B2

(12) United States Patent
Bortoluzzi et al.

(10) Patent No.: US 10,221,605 B2
(45) Date of Patent: Mar. 5, 2019

(54) ABUTMENT ELEMENT FOR DAMPERS OF SLIDING DOORS

(71) Applicant: BORTOLUZZI SISTEMI S.P.A., Belluno (IT)

(72) Inventors: Guido Bortoluzzi, Belluno (IT); Bruno Sponga, Belluno (IT); Adriano Girotto, Belluno (IT); Lucio Moliner, Belluno (IT)

(73) Assignee: BORTOLUZZI SISTEMI S.P.A., Belluno (IT)

( * ) Notice: Subject to any disclaimer, the term of this patent is extended or adjusted under 35 U.S.C. 154(b) by 0 days.

(21) Appl. No.: 15/125,165

(22) PCT Filed: Mar. 27, 2015

(86) PCT No.: PCT/IB2015/052262
§ 371 (c)(1),
(2) Date: Sep. 11, 2016

(87) PCT Pub. No.: WO2015/150999
PCT Pub. Date: Oct. 8, 2015

(65) Prior Publication Data

US 2017/0074018 A1 Mar. 16, 2017

(30) Foreign Application Priority Data

Apr. 1, 2014 (IT) ..... TV2014A0051

(51) Int. Cl.
*E05F 5/00* (2017.01)
*E05F 5/02* (2006.01)

(52) U.S. Cl.
CPC ..... *E05F 5/003* (2013.01); *E05F 5/02* (2013.01); *E05Y 2201/21* (2013.01); *E05Y 2201/26* (2013.01); *E05Y 2201/638* (2013.01); *E05Y 2900/20* (2013.01); *Y10T 16/61* (2015.01)

(58) Field of Classification Search
CPC .... E05F 5/003; E05F 5/02; E05F 5/08; E05Y 2201/21; E05Y 2201/26; E05Y 2201/638; E05Y 2900/20; Y10T 16/61; Y10T 16/625
USPC ..... 16/82, 85; 292/DIG. 15, DIG. 19
See application file for complete search history.

(56) References Cited

U.S. PATENT DOCUMENTS

| | | | | |
|---|---|---|---|---|
| 2,869,171 A * | 1/1959 | Levine | ..... | E05F 5/003 16/83 |
| 8,763,204 B2 * | 7/2014 | Inaguchi | ..... | E05F 5/003 16/82 |
| 2010/0071154 A1 * | 3/2010 | Bortoluzzi | ..... | E05F 1/16 16/85 |

FOREIGN PATENT DOCUMENTS

| | | | | |
|---|---|---|---|---|
| EP | 2 365 168 A2 | 9/2011 | | |
| EP | 2365168 A2 * | 9/2011 | ..... | E05D 13/04 |

* cited by examiner

*Primary Examiner* — William L Miller
(74) *Attorney, Agent, or Firm* — Mark M. Friedman

(57) ABSTRACT

An abutment element (B1, B2) is described adapted to be arranged on a profile (10) mounted on a furniture item, on the profile being able to slide a shock-absorber that is integral with a door and which is mounted to meet the abutment element to activate. The element has a portion (32, 52) slidably couplable to the profile so that the abutment element can slide on the profile without detaching; and a modifiable structure for creating a constraint to the sliding of the abutment element so as to make it integral with the profile. Thereby easy assembly and lack of screw-hole are assured.

9 Claims, 4 Drawing Sheets

Fig. 8
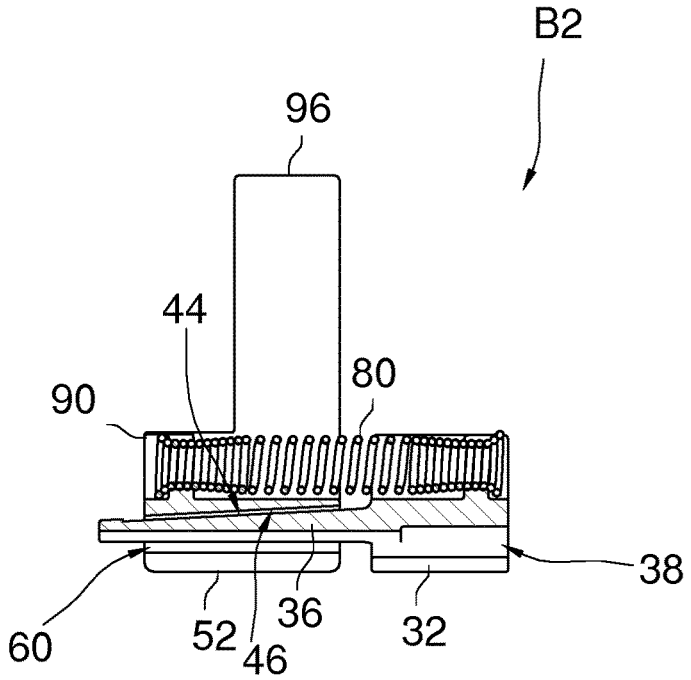
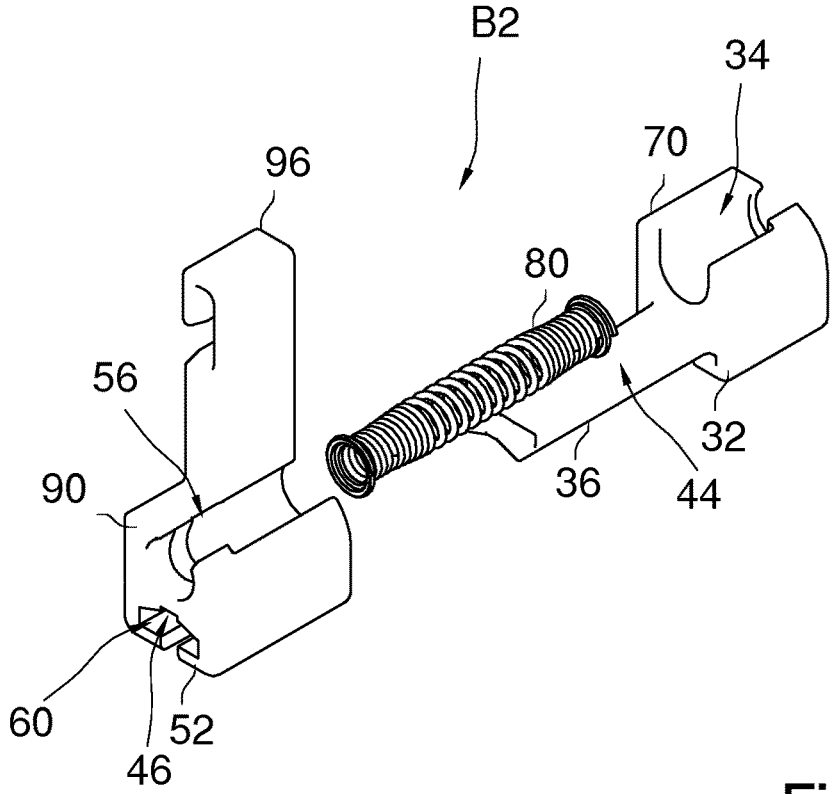
Fig. 9

ABUTMENT ELEMENT FOR DAMPERS OF SLIDING DOORS

CROSS-REFERENCE TO RELATED APPLICATIONS

The present patent application is a U.S. National Phase application from, and claiming priority to, Applicant's international patent application filed 27 Mar. 2015 under the PCT having International Application Number PCT/IB2015/052262. The present patent application also claims priority to Applicant's Italian patent application having patent application number TV2014A000051 and filed 1 Apr. 2014.

STATEMENT REGARDING FEDERALLY SPONSORED RESEARCH OR DEVELOPMENT

Not Applicable

THE NAMES OF THE PARTIES TO A JOINT RESEARCH OR DEVELOPMENT

Not Applicable

INCORPORATION-BY-REFERENCE OF MATERIAL SUBMITTED ON A COMPACT DISC OR AS A TEXT FILE VIA EFS-WEB

Not Applicable

STATEMENT REGARDING PRIOR AR DISCLOSURES BY THE INVENTOR OR A JOINT INVENTOR

Not Applicable

BACKGROUND OF THE INVENTION

Field of the Invention

The invention relates to an abutment element for dampers (shock-absorbers) of sliding doors, to a method for its production and assembly.

Description of the Related Art

On certain cabinets there are mounted sliding doors in order to avoid the disadvantages of the hinged ones, i.e. smaller closing surfaces of a compartment and bulky opening radii. Each sliding door is supported by a pair of brackets connected to carriages equipped with wheels sliding inside a rail, formed in a metal profile, arranged on the ceiling of the cabinet. To prevent that an excessive thrust on the door can make it crash into the end-of-travel stop, damping devices (shock absorbers) are used, integral with the door, which are activated only in the final part of the stroke. The damping devices are activated (or deactivated) when, while sliding with the door, they meet locators (called "activators") fixed to the rail, positioned at appropriate points during assembly of the mechanism (see e.g. US2010071154).

Typically the activators are fixed by screws to the profile. One must not only bore the profile (delicate and expensive operation) but any boring or positioning error can ruin the profile or impose its replacement. Also, it is impossible to remove or move the activator without ruining the profile, and it is very difficult to adjust the position of the activator after any boring (e.g. to compensate for tolerances).

To obviate at least one of these problems is the main object of the invention, which is defined in the appended claims, in which the dependent ones define advantageous variants.

BRIEF SUMMARY OF THE INVENTION

It is proposed therefore a method for anchoring an abutment element to a profile mounted on a furniture item, on the profile being able to slide a shock-absorber, integral with a door, which is activated when it encounters the abutment element, wherein (ia) the abutment element is slidably coupled to the profile so that the first is able to slide on the second without detaching; and (iia) the position of the abutment element is fixed on the profile by creating a constraint to its sliding.

It is also proposed a method for producing an abutment element which can be anchored to said profile wherein (ib) the abutment element is produced slidably couplable to the profile so that the first is able to slide on the second without detaching; and (iib) the abutment element is produced fixable to the profile by means of the creation of a constraint to its sliding.

Note that the anchoring system for activators and/or the production system extends easily to any other object that one wants to make rigid or integral with the profile without having to intervene by means of a invasive or destructive mechanical connection, e.g. like a screw.

It is also proposed an abutment element, adapted to be arranged on said profile, comprising a portion slidably couplable to the profile so that the abutment element can slide on the section without detaching;

the element having a modifiable structure for creating a constraint to the sliding of the abutment element so as to make it integral with the profile.

By modifiable structure we here mean that the body or said couplable portion of the abutment element is constructed to modify its shape in order to create said constraint.

The methods and the abutment element speed up the fixing times of the activators to the profile and facilitate the regulation of the same. In fact, one gets rid of screws or invasive fastening means and of the relevant assembly time. Not only one can remove the abutment element without damaging the profile, but since the element itself integrates or comprises means for anchoring/fixing to the profile it can be easily anchored during assembly and by trial and error set into the right position.

The methods and the abutment element have many advantageous variations, and the variants described for one can be implemented for the other.

For example, the step (iia) or (iib) can be obtained through a wedge insertable between the abutment element and the profile, particularly if the step (iib) is obtained by producing the abutment element as two pieces, one of which has a wedge jointable between the profile and a part of the other.

The anchoring or attachment means can also comprise a clamp structure which can be tightened to lock the element on a point of the profile, e.g. the same slidably-couplable portion can have deformable structure or movable jaws to lock on the profile.

As a very simple variant (it requires no moving parts or complex structure, and is very durable and inexpensive) the element can comprise a wedge jointable between the portion and the profile in order to anchor the abutment element to the profile by friction. The frictional force generated by the mutual fitting is therefore exploited.

Preferably the element comprises two pieces, wherein one piece comprises the said portion and the other the wedge, and the pieces are able to be neared to each other to joint the wedge. The two-piece structure implements in a simple but efficient manner the anchoring via a wedge and friction. It also makes the disassembly very easy, sufficing the separation of the two pieces.

Preferably the element comprises an elastic element mounted for pulling the two pieces toward one another. The object is to assure a stable joint and to avoid accidental disconnections.

Preferably said portion has the form of a hook, for a shape-fitting with a complementary guide on the profile, and defines a concavity inside which the wedge is jointable. In this manner the wedge can be located between the profile and the portion in order to block it at a point by friction.

Preferably the wedge and the concavity each have an inclined plane of substantially the same inclination.

To provide such inclined surfaces that abut during the anchoring and create a pressure or compression force between the portion and the profile is an easy way to exploit and enhance the friction as blocking agent. The inclined planes do not weaken the structure of the abutment element and their inclination is a degree of design freedom to determine the dynamics and/or the strength of the anchoring. Some profiles e.g. could be less resistant than others (e.g. made out of plastic) and request more calibrated anchorings.

BRIEF DESCRIPTION OF THE SEVERAL VIEWS OF THE DRAWINGS

The advantages of the invention will be more apparent from the following description of preferred embodiments, making reference to the attached drawing in which

FIG. 8 shows an isolated second abutment element seen from a side;

FIG. 9 shows the element of FIG. 8 in exploded view.

DETAILED DESCRIPTION OF THE INVENTION

In the figures, identical numbers indicate identical or conceptually similar parts, and the elements are described as being in use.

Figure 1:
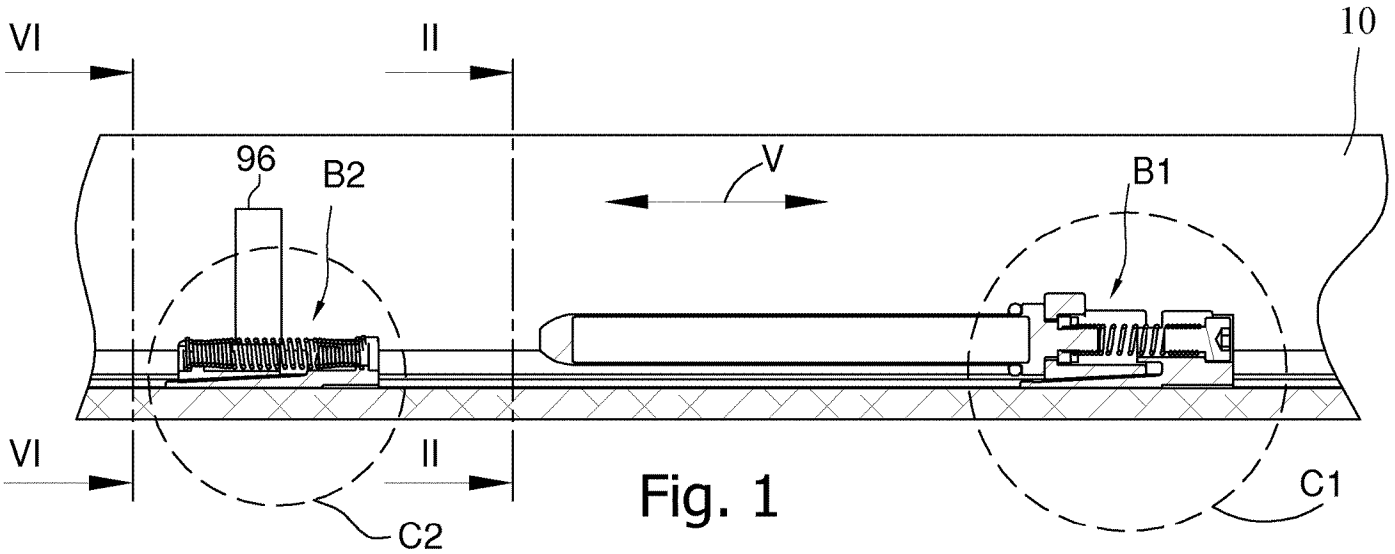
FIG. 1 shows a side view of a profile for sliding doors with two abutment elements mounted on them.
Figure 2:
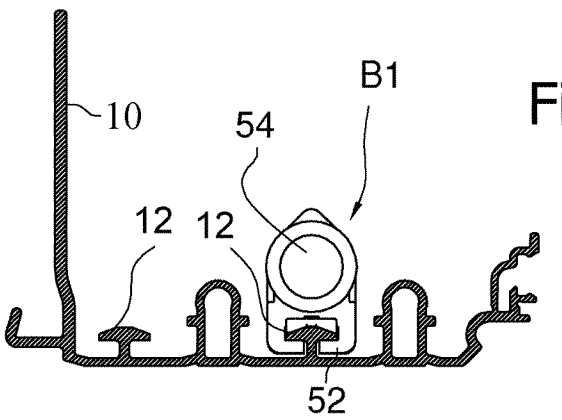
FIG. 2 shows a cross-section along the plane II-II of FIG. 1.
Figure 6:
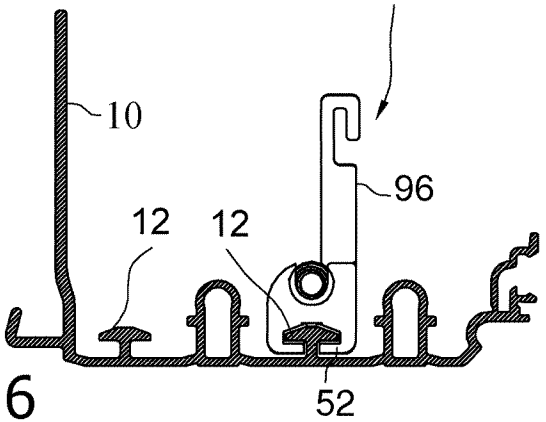
FIG. 6 shows a cross-section along the plane VI-VI of FIG. 1.
Figure 3:
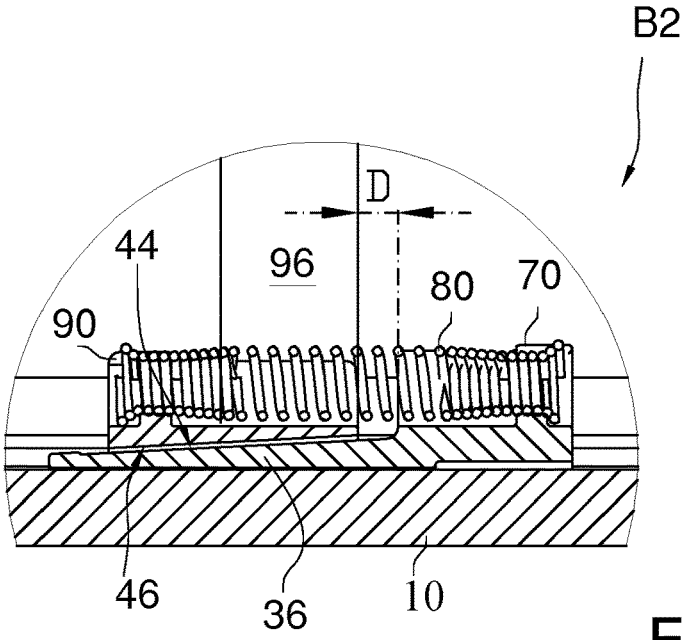
FIG. 3 shows an enlargement of the dotted circle C1 in FIG. 1.
Figure 7:
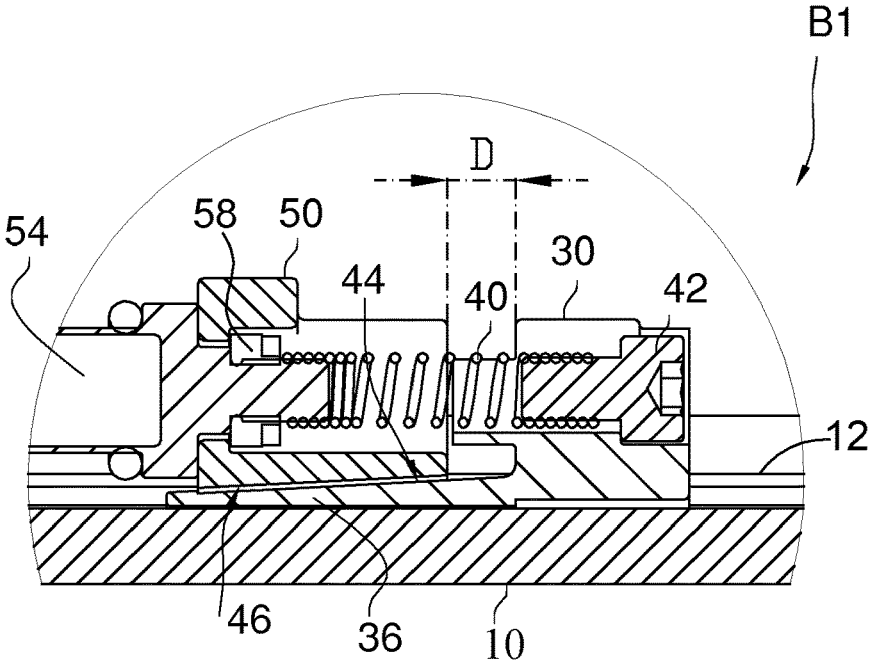
FIG. 7 shows an enlargement of the dotted circle C2 in FIG. 1.
Figure 4:
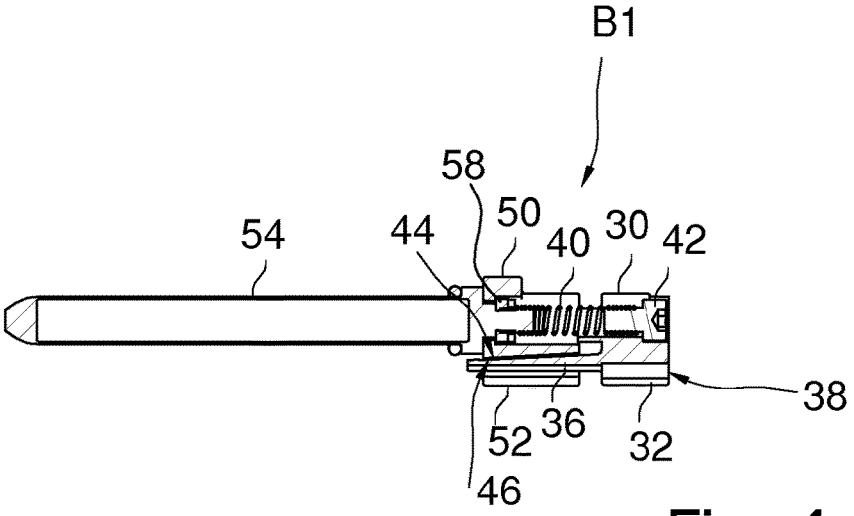
FIG. 4 shows isolated an abutment element seen from a side.
Figure 5:
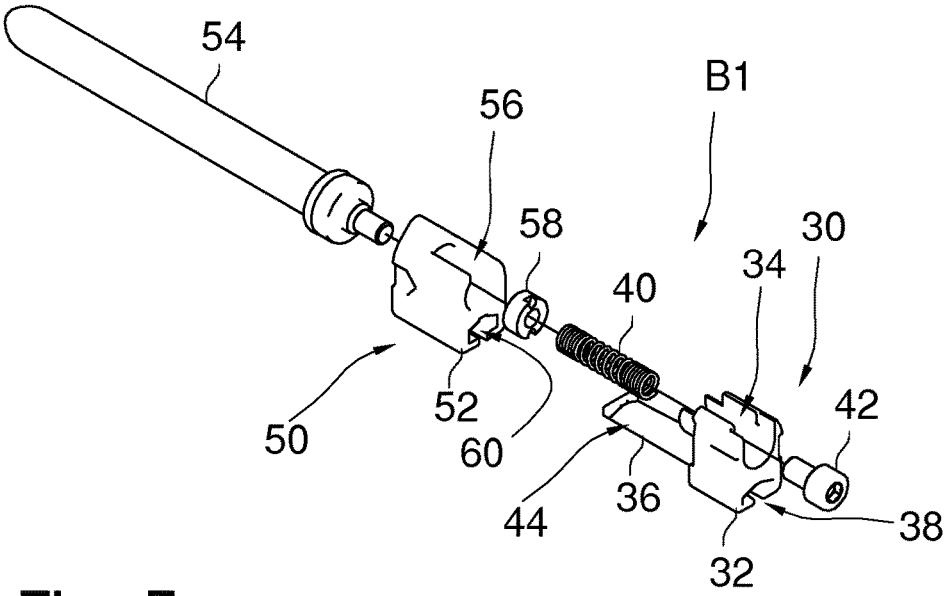
FIG. 5 shows the element of FIG. 4 in exploded view.

FIG. 1 shows a profile 10, e.g. made of metal, shaped to constitute guide rails for wheels of sliding carriages to which doors are fixed in a known way. In particular, the profile 10 comprises one or more projections, with T-shaped cross-section, indicated with 12, to which there is slidably fastenable an abutment element B1 (FIGS. 2-5) which is formed by two pieces 30, 50.

The first piece 30 comprises at the base an optional hook-shaped portion 32, in particular a C-shaped cross-section portion, which delimits a seat 38 (e.g. between the two wings of the C). Two upper lateral walls define a seat 34 in which a screw 42 is inserted, while on one side extends an element 36, wedge-shaped, having an inclined plane 44. The inclination is referred to the sliding direction V on the profile 10 (FIG. 1), i.e. parallel to the lying plane of the profile 10.

The second piece 50 comprises at the base a hook-shaped portion 52, in particular with a C-shaped cross-section portion, which delimits a seat 60 between the two wings of the C. The upper wall of the seat 60 is constituted by an inclined plane 46, preferably oriented as the plane 44. Two upper lateral walls define a seat 56 in which is inserted a safety washer 58, while in front of the piece 50 there is fixed or fixable a cylinder 54.

The element 36 has such dimensions that it can be inserted inside the seat 60.

Between the screw and the safety washer 58 there is placed in traction an optional spring 40, so that on the pieces 30, 50 a force is always applied tending to bring them closer to one another. Preferably the seats 60 and 38 have the same geometry.

Operation

When mounting the sliding mechanism for the door, the abutment element B1 is placed at a suitable point along the profile 10. Therefore, the projection 12 is inserted into the seats 60, 38 (FIG. 2) by keeping the pieces 30, 50 slightly away from each other. In this way, the portions 52, 32 embrace the projection 12 and the pieces 30, 50 can slide freely on and along the profile 10 but without being able to detach from it. Note (FIG. 4) that in this configuration the element 36 takes up little space of the seat 60 and does not interfere (the inclined planes 44, 46 do not touch). Reached the established point in which to fix the abutment element B1, the pieces 30, 50 are moved closer to one another, to cause further penetration of the element 36 in the seat 60. The inclined planes 44, 46 slide over one another and the piece 50, pushed by the piece 30, perpendicularly moves away from the profile 10 until the portion 52 abuts and presses against the projection 12. To such pressure corresponds a frictional force between the portion 52 and the projection 12 which stably anchors the element B to the profile 10.

The spring 40 ensures the stable wedging of element 36 inside the seat 60 and/or avoids accidental detachments between the pieces 30, 50 and therefore the loss of grip on the profile 10. However, only forced interlocking can be sufficient.

The shock-absorber of the door (not shown) activates when it ends up touching the cylinder 54.

When one wants to re-move the element B1, it is sufficient to move the pieces 30, 50 apart, e.g. by inserting and then turning a screwdriver pin inside a slot of width D which advantageously is made to remain between the pieces 30, 50 when attached. The pieces 30, 50, for this purpose, can have such a shape that even at maximum reciprocal joint there is a gap between them.

A variant of the abutment element B2, which uses the same principle of construction and assembly and has two pieces 70, 90, is shown in FIGS. 6-9.

Equal parts, indicated by the same references, will not be re-described for the sake of brevity. As previously the pieces 70, 90 have hook portions 32, 52; a wedge 36 with inclined planes 44, 46 which work in the same way, and seats 34, 56 bounded by vertical walls.

The main differences for the element B2 are a different projecting activator element, that is, a vertical hook 96, and an optional helical spring 80 between the pieces 70, 90 which has flared or enlarged ends through the enlargement of some of the windings. Such a spring draws the pieces 70, 90 toward one another because the enlarged ends abut on and push teeth 82, 92 embossed inside the seats 56, 34 of the piece 70, 90 respectively.

It is clear that the assembly system and/or the abutment elements described:

speed up the time for fastening an abutment element to the profile 12;

the position control is much (more) easy, allow to remove the abutment element without damaging the profile with boring or other;

one can use them without tools, ultimately overall manually.

The invention is open to many variations. E.g. possible variations in the abutment elements with respect to those described are:

different types of activating organs (all the known ones), which can be integral with one or the other of the two pieces that form the abutment element;

an elastic means different from the spring 40, 80, e.g. a plate or cup spring, a rubber band, etc., always with the function of bringing the two pieces closer;

different shapes for the portions 32, 52, e.g. with T-section to make it slide in a C-shaped groove in the profile 10, or generally a portion able to engage through sliding interlocking (a prismatic pair) on a corresponding groove or relief present on the surface of the profile. This portion can be deformable or have variable geometry for anchoring to the profile (e.g. the C-shaped portions can have jaws clampable to tighten the protrusions 12);

different shape or geometry (e.g. length or width) for the element 36 adapted to wedge itself into the seat 60, in particular different shape or inclination of the inclined planes 44, 46.

It is understood, finally, that the anchoring system for the abutment element, with all its variations, can be implemented on any type of known activator, and also to any other component that one wants to make integral to the profile 12 without mechanical screw-connection.

The invention claimed is:

1. A method of anchoring an abutment element, comprising:

anchoring the abutment element to a profile mounted on a furniture item, such that the abutment element is configured to slide on the profile during the anchoring, and such that a shock-absorber integral with a door of the furniture item is activated when the shock-absorber encounters the abutment element, wherein (ia) during the anchoring the abutment element is slidably coupled to the profile so that the abutment element is able to slide on the profile without detaching; and wherein (iia) the position of the abutment element is fixed on the profile once the abutment element is anchored by inserting a wedge between the abutment element and the profile so as to create a constraint that prevents the abutment element from further sliding on the profile.

2. A method according to claim 1, further comprising producing the abutment element as two pieces, namely a first piece and a second piece, wherein the first piece comprises said wedge joinable between the profile and a part of the second piece.

3. A method of producing an abutment element, comprising:

producing the abutment element so as to be anchored to a profile mounted on a furniture item and such that a shock-absorber integral with a door of the furniture item, is activated when the shock-absorber encounters the abutment element, wherein (ib) the abutment element is produced slidably couplable to the profile so that the abutment element is able to slide on the profile without detaching; and wherein (iib) the abutment element is produced such that after the abutment element is coupled to the profile, and a wedge is inserted between the abutment element and the profile, the abutment element becomes fixed to the profile and is constrained from further sliding on the profile.

4. A method according to claim 3, further comprising producing the abutment element as two pieces, one of which has the wedge joinable between the profile and a part of the other.

5. An abutment element adapted to be arranged on a profile mounted on a furniture item such that a shock-absorber integral with a door of the furniture item is activated when the shock-absorber meets the abutment element, the abutment element comprising a portion slidably couplable to the profile so that the abutment element can slide on the profile without detaching; the abutment element also comprising a wedge joinable between a portion of the abutment element and the profile to anchor the abutment element to the profile by friction and thereby create a constraint to the sliding of the abutment element so as to make the abutment element integral with the profile.

6. An abutment element according to claim 5, comprising two pieces, namely a first piece and a second piece, wherein the first piece comprises the said portion and the second piece comprises the wedge, the first and second pieces configured to be put near one another to joint the wedge between the profile and the first piece.

7. An abutment element according to claim 6, comprising an elastic element mounted for pulling the two pieces toward one another.

8. An abutment element according to claim 5, wherein the portion has a form of a hook and defines a concavity, wherein inside the cavity the wedge is joinable.

9. An abutment element according to claim 8, wherein the wedge and the concavity each have an inclined plane of substantially the same inclination.

* * * * *